United States Patent [19]

Grenier et al.

[11] 4,402,628

[45] Sep. 6, 1983

[54] PAVEMENT MARKER

[75] Inventors: Wilfred J. Grenier, Rutland; Lee B. Zuckerman; John P. Ferris, both of Worcester; Joseph DeFalco, Shrewsbury, all of Mass.

[73] Assignee: General Industries, Inc., Rutland, Mass.

[21] Appl. No.: 245,990

[22] Filed: Mar. 20, 1981

[51] Int. Cl.[3] ..... E01F 9/04

[52] U.S. Cl. ..... 404/16

[58] Field of Search ..... 404/15, 16; 350/97; 116/63 R

[56] References Cited

U.S. PATENT DOCUMENTS

| | | | |
|---|---|---|---|
| 1,647,861 | 11/1927 | Furey | 404/15 |
| 1,696,510 | 12/1928 | Wallace | 404/15 |
| 1,746,312 | 2/1930 | Lee | 404/15 |
| 1,764,073 | 6/1930 | Furey | 404/15 |
| 1,927,756 | 9/1933 | Ross | 404/16 |
| 2,127,037 | 8/1938 | LaCroix | 404/16 |
| 2,142,803 | 1/1939 | Robertson | 404/16 |
| 2,260,498 | 10/1941 | Wise | 404/16 |
| 2,627,784 | 2/1953 | Pellar | 404/16 |
| 3,093,038 | 6/1963 | McRobbie | 404/16 |
| 3,980,410 | 9/1976 | Suhr | 404/16 |
| 4,147,447 | 4/1979 | Heenan | 404/16 |
| 4,155,666 | 5/1979 | Flanagan | 404/16 |

FOREIGN PATENT DOCUMENTS

| | | | |
|---|---|---|---|
| 497455 | 12/1950 | Belgium | 404/16 |
| 275345 | 5/1951 | Switzerland | 404/16 |
| 452962 | 9/1936 | United Kingdom | 404/15 |

*Primary Examiner*—Nile C. Byers, Jr.

[57] ABSTRACT

A hardened steel pavement marker having a base with raised protective cross ribs and reflectors thereon, and a depending skirt for embedment in the pavement, the skirt being scalloped and having holes therein.

9 Claims, 3 Drawing Figures

PAVEMENT MARKER

BACKGROUND OF THE INVENTION

It is recognized that roads in many cases should be plainly marked, especially on the surface of the pavement, and the best way is to use reflectors. However, reflectors are easily damaged and dislodged by traffic and snowplows and may become obscured. It is the purpose of this invention to provide a substantially permanent reflective marker that is easily installed and resistent to damage.

SUMMARY OF THE INVENTION

A reflective pavement marker embedded in the pavement and carrying reflectors. The construction is essentially cross-ribbed preventing snowplows from striking the reflectors, the ribs being raised members and the reflectors being less in height. Protection is provided whatever relative direction the plow travels. The marker is of hardened steel, preferably stainless, and has a base for the cross ribs and reflectors and a scalloped and apertured skirt for embedment in the pavement.

PREFERRED EMBODIMENT OF THE INVENTION

The present marker is made of a hardened steel, preferably stainless and harder than the usual snowplow. It is in inverted U shape, or inverted cup shape, having a base 10 and a surrounding depending skirt 12. This skirt has recesses 14 therein as well as apertures 16. The skirt is preferably long enough to penetrate or be embedded in two layers of hard-top pavement, and the recesses and apertures provide additional adherence to the pavement with the base exposed.

Figure 2:
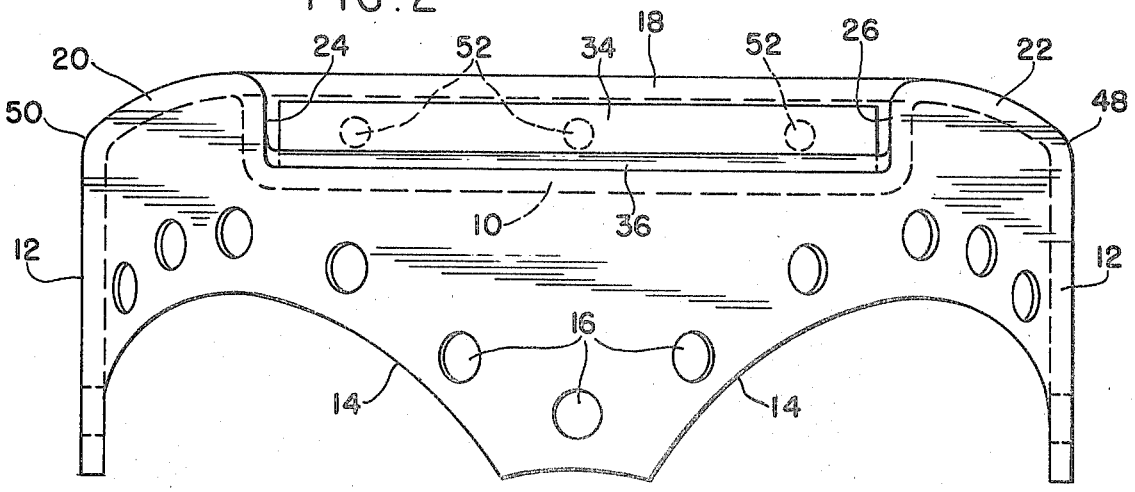
FIG. 2 is a view in elevation.

The base is provided with a diametrical fold 18 rising up from the surface of the base. This fold forms a rib or ridge with a generally convex edge, part of which may be flat, FIG. 2, centrally thereof. As a snowplow engages the marker when traveling parallel to the ridge, it slides up over it, the ridge generally coinciding with base 10 at its ends.

At each end of the fold or ridge 18 there is a raised area 20, 22 generally at right angles to ridge 18. Each member 20,22 has a straight edge 24,26 centrally merging into the ridge 18 as at 28,30, and as shown in FIG. 3, these members have convex edges for snowplow protection in a direction at right angles to fold or ridge 18.

The fold or ridge 18 and the members 20,22 together with base 10 form a pair of three-sided recesses or boxes in which and protected thereby are reflectors 32,34, which are seen to lie below the edges of the ridge 18 and members 20,22. The reflectors are clearly visible. They may be physically attached or held in place on base 10 by adhesives. As an extra protection, elongated ridges 36,38 are formed in the base. Ridges 36,38 extend along the lesser edges 40,42 of the reflectors, which have slanted surfaces 44,46, for better reflection. The base 10 on opposite sides of the diametric ridge 18 between the members 20,22 is substantially flat except where the ridges 36 and 38 rise therefrom. The underside of base

Figure 3:
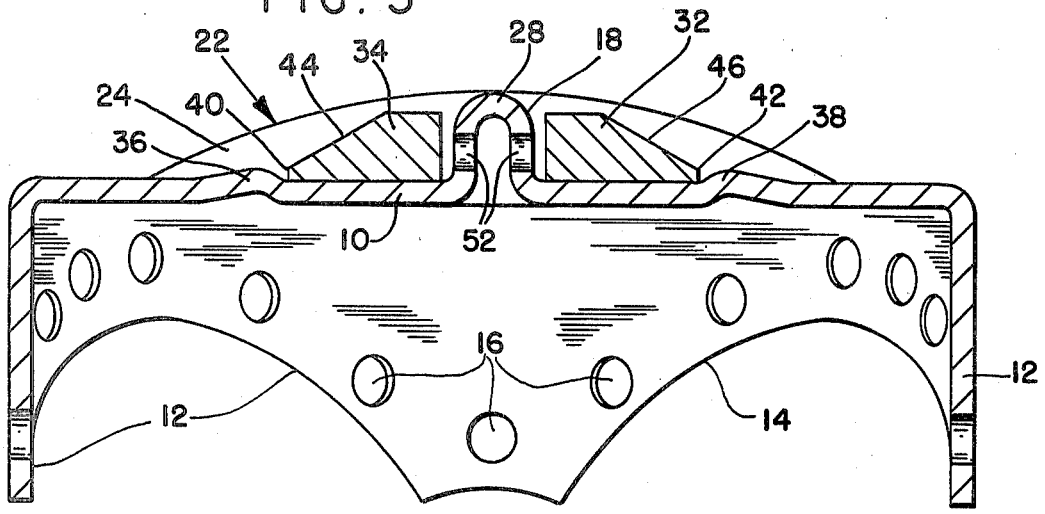
FIG. 3 is a section on line 3—3 of FIG. 1.

10, as seen in FIG. 3, presents a substantially flat surface.

The ridge 18 and members 20,22 insure positive protection to the reflectors no matter in what direction the snowplow is traveling. The radii lifts the plow blade over the reflectors and prevents solid blows which might loosen the marker.

Figure 1:
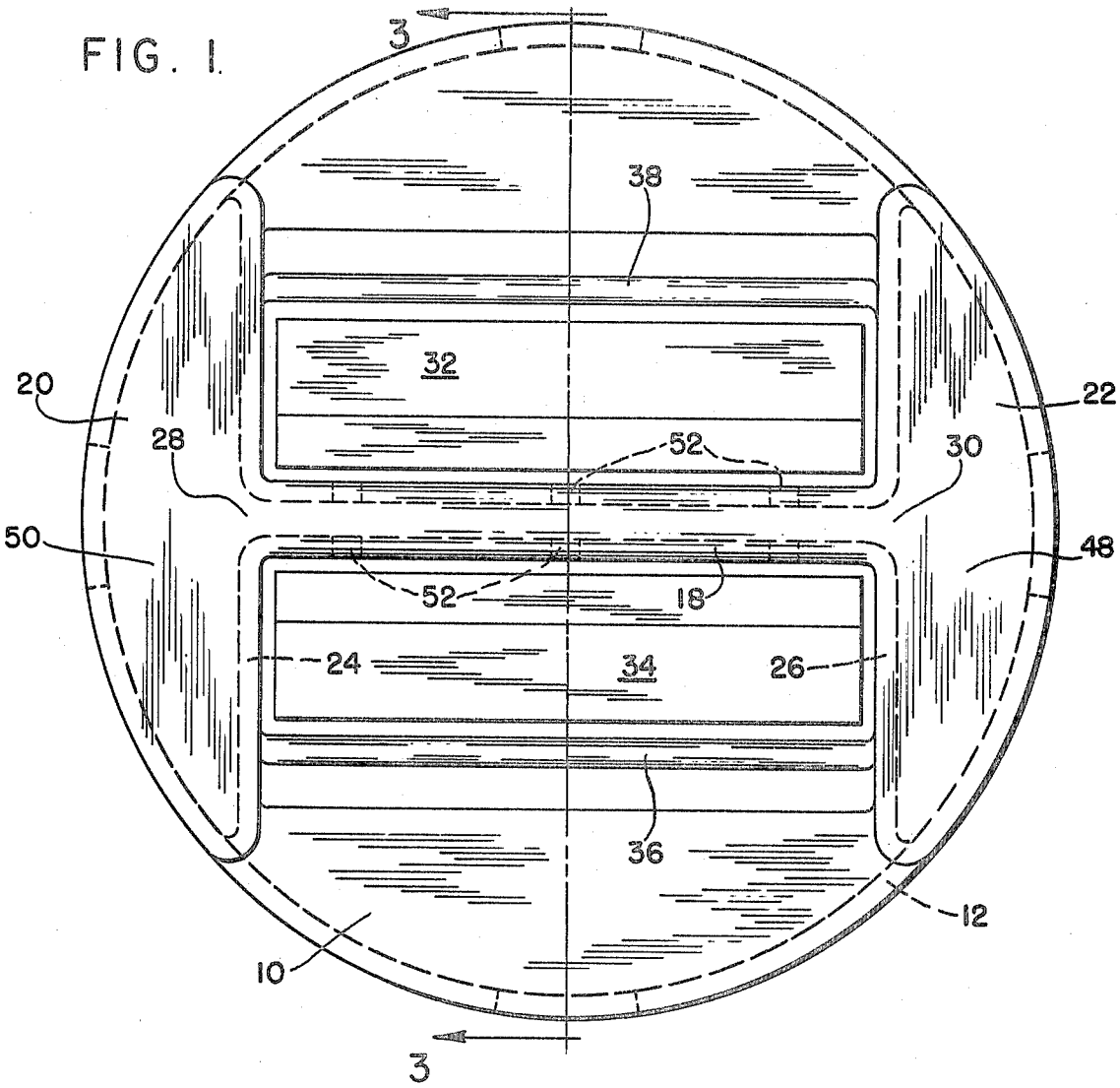
FIG. 1 is a plan view.

Looking at FIG. 1, it will be seen that the ridge 18 and end members 20 and 22 are in the form of a dumbbell or weight for exercizing, and the outer edges of the latter as at 48,50 are on an arc and merge into the base 10 so that no matter the angle, the plow blade will be lifted over the reflectors 32, 34.

The fold or ridge 18 has sides spaced from the higher sides of the reflectors and ridge sides are apertured as at 52. The marker is usually installed by boring a hole in the pavement, filling it with a flowable material, e.g. blacktop or wet cement, and pushing the skirt 12 down into position. The holes 52 are escape or "weep" holes, allowing excess material to escape from the marker preventing air holes. The material passes into the spaces between the reflectors and the sides of ridge 18, and usually this is sufficient, but should it spread out onto one or the other reflector it can be wiped off before setting.

Two reflectors are disclosed, but in some cases e.g. one way streets and road edges, only one reflector will be needed.

We claim:

1. A raised plowable pavement marker comprising a hardened steel inverted cup-shaped member including a base and a full surrounding circular depending skirt, said skirt having means to hold the marker to a pavement with the skirt embedded, a diametric ridge on the base rising above the base and presenting a convex edge for a plow to ride over, first and second members each having a convex edge, rising above the base, said first and second members being generally at right angles to said diametric ridge an being located at opposite ends of said diametric ridge respectively, said first and second members each having a surface extending laterally on opposite sides of said diametric ridge, said surface rising from a peripheral edge portion of said inverted cup-shaped member and merging with said diametric ridge in the longitudinal direction of said ridge and forming a symetrical transverse arch rising from said base on opposite sides of said diametric ridge to a peak coinciding with the top of said diametric ridge, said diametric ridge and said first and second members together with said base forming a pair of recesses on opposite sides of said diametric ridge, said recesses each having an open side opposite said diametric ridge between said first and second members, said base between said first and second members on opposite sides of said diametric ridge being substantially flat, at least one elongated reflector secured to said bases and located in one of said recesses alongside and substantially parallel with said diametric ridge, said first and second members at the ends of said diametric ridge serving to protect the market and reflector from a snowplow traveling in a direction normal to said diametric ridge.

2. The marker of claim 1 wherein said reflector has an exposed surface slanting down from said ridge.

3. The marker of claim 1 wherein said reflector has a flat bottom surface contiguous with said base, a rear wall adjacent to said diametric ridge and of less height than said diametric ridge, a front wall of less height than said rear wall, and an exposed slanting surface facing outwardly through the open side of said recess.

4. The marker of claim 1, together with a pair of elongated ridges formed in said base, parallel to and spaced outwardly from said diametric ridge on opposite sides thereof respectively, sid elongated ridges extending between said first and second members and forming protective means in front of reflectors located in said recesses.

5. The pavement marker of claim 1 including a second elongated reflector secured to said base and located in the other of said recesses alongside and substantially parallel with said diametric ridge at the opposite side of the diametrical ridge.

6. The pavement marker of claim 1 wherein the means on the skirt to hold the marker in the pavement includes recesses in the skirt, said recesses extending inwardly from the edge of the skirt.

7. The pavement marker of claim 6 wherein said means on the skirt includes apertures therein.

8. The pavement marker of claim 6 wherein the convex edges merge into the base on an arc at the edge of the base.

9. The pavement marker of claim 1 wherein the reflector has a slanted surface.

* * * * *